US009212518B2

(12) United States Patent
Mann

(10) Patent No.: US 9,212,518 B2
(45) Date of Patent: Dec. 15, 2015

(54) CONTROL DEVICE FOR SHADES

(71) Applicant: Bill Mann, Lino Lakes, MN (US)

(72) Inventor: Bill Mann, Lino Lakes, MN (US)

( * ) Notice: Subject to any disclaimer, the term of this patent is extended or adjusted under 35 U.S.C. 154(b) by 0 days.

(21) Appl. No.: 14/215,844

(22) Filed: Mar. 17, 2014

(65) Prior Publication Data

US 2014/0262080 A1 Sep. 18, 2014

Related U.S. Application Data

(60) Provisional application No. 61/798,012, filed on Mar. 15, 2013.

(51) Int. Cl.

| | |
|---|---|
| ***A47H 5/032*** | (2006.01) |
| ***E06B 9/324*** | (2006.01) |
| *E06B 9/44* | (2006.01) |
| *E06B 9/50* | (2006.01) |
| *E06B 9/78* | (2006.01) |

(52) U.S. Cl.

CPC . *E06B 9/324* (2013.01); *E06B 9/44* (2013.01); *E06B 9/50* (2013.01); *E06B 2009/785* (2013.01)

(58) Field of Classification Search

CPC ..... A47H 5/032; E06B 9/36; E06B 9/361; E06B 9/364

USPC ..... 160/321, 258, 293.1, 168.1 V, 307, 308

See application file for complete search history.

(56) References Cited

U.S. PATENT DOCUMENTS

| | | | | |
|---|---|---|---|---|
| 4,865,109 | A * | 9/1989 | Sherman | 160/321 |
| 4,884,618 | A * | 12/1989 | Steeves | 160/321 |
| 5,163,492 | A * | 11/1992 | Remington et al. | 160/176.1 V |
| 5,752,558 | A * | 5/1998 | Lin | 160/320 |
| 6,250,359 | B1 * | 6/2001 | Lorio et al. | 160/178.1 V |
| 6,516,860 | B1 * | 2/2003 | Weaver et al. | 160/168.1 R |
| 7,353,857 | B2 * | 4/2008 | Koop | 160/178.1 R |
| 8,376,022 | B2 * | 2/2013 | Lin | 160/321 |
| 8,650,720 | B2 * | 2/2014 | Wicker et al. | 24/115 G |
| 8,726,972 | B1 * | 5/2014 | Wills | 160/321 |

* cited by examiner

*Primary Examiner* — Blair M Johnson

(74) *Attorney, Agent, or Firm* — Briggs and Morgan, P.A.

(57) ABSTRACT

A chain control device for inhibiting movement of chains used in window blinds, shades and the like for moving the blinds between operative positions. The chain control device is secured at a location remote from the shades' clutch/drive housing. The chain control device is characterized by redirecting tension forces applied by the user of the blinds away from the shade drive.

18 Claims, 12 Drawing Sheets

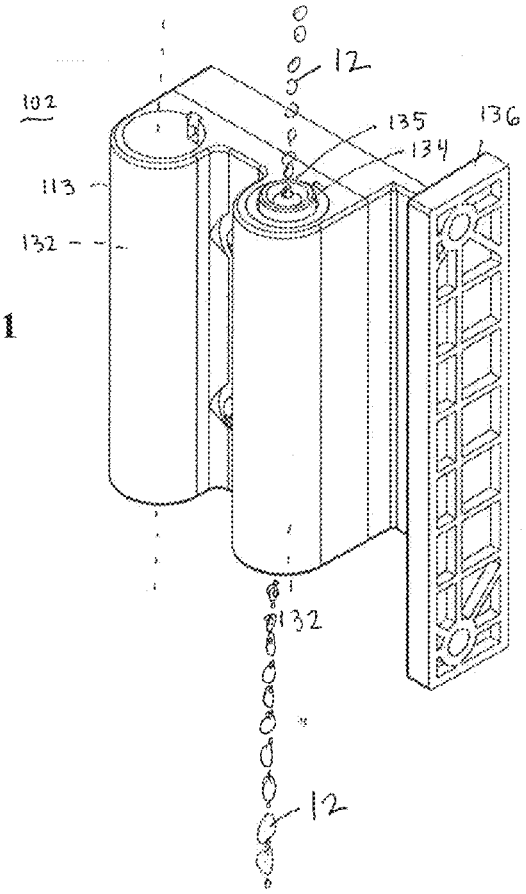
FIG. 11
FIG. 12
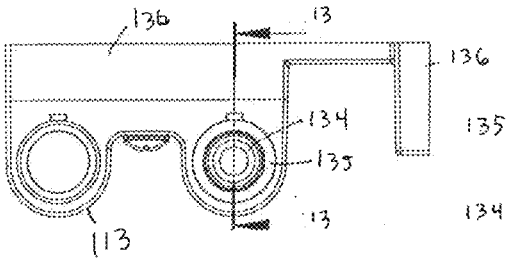
FIG. 13
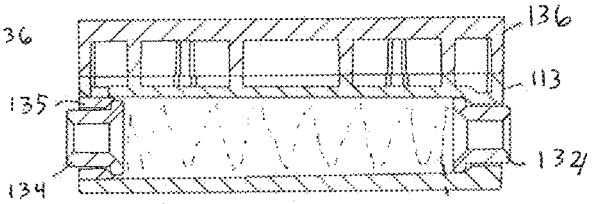

CONTROL DEVICE FOR SHADES

RELATED APPLICATIONS

This application claims the benefit of U.S. Provisional Application No. 61/798,012 filed Mar. 15, 2013, which application is incorporated by reference.

TECHNICAL FIELD

The present invention relates generally to chain control devices for roller shades, curtains or blinds or the like, and more specifically to a chain control device that minimizes jamming and chain disengagement and also prompts a user to move the chain in a direction to effect a desired movement of shades or curtains and within a desired chain tension range.

BACKGROUND OF THE INVENTION

Chain operating systems for window blinds are known in the art. They generally include a sprocket or drive wheel for driving a driven blind member such as a drive shaft, a ball chain operatively engaging the sprocket wheel, a cover on the sprocket wheel and a chain stopper on the ball chain. In these systems, the sprocket wheel is drivingly connected to a driven member of a blind. For example, the blind may be a roller blind or a vertical venetian blind. A sprocket wheel can also drive other blinds, such as a horizontal venetian blind or a roman shade. The driven member can be a conventional drive shaft of a roller blind, a central control shaft of a roman shade, a lift or tilt shaft of a horizontal venetian blind or a traverse or tilt shaft of a vertical venetian blind, or the like.

The ball chain, in such systems, comprises a plurality of spaced apart balls. The ball chain is looped over the sprocket wheel to operatively engage it, so that first and second depending portions of the ball chain are on either side of the sprocket wheel. By pulling one of the depending portions of the ball chain, the sprocket wheel is rotated in either a clockwise or counter-clockwise direction, and the driven shaft also is rotated. This results in a roller blind being rolled up or unrolled, a venetian blind being tilted or lifted or lowered, a vertical venetian blind being traversed or tilted or a roman shade being lifted or towered.

The sprocket wheel, in such systems, is typically hidden with a cover. The cover generally is over at least the part of the sprocket wheel where the ball chain is looped over it, but open top covers are also known (e.g., U.S. Pat. No. 2,577,046). The cover is open at the bottom for passage of the opposite depending portions of the ball chain. The cover acts as a guiding means to guide the ball chain into engagement with the sprocket wheel and prevent the ball chain from disengaging from the sprocket wheel.

In such systems, ball chains have been provided with one or more separate members which act as chain stoppers. The stoppers are adapted to block movement of the ball chains into the mechanism, thus stopping the rotation of the sprocket wheels and operating movement of the blinds. They have also been used to prevent ball chain from being pulled further than necessary for performing desired operating movements of the blinds, for example, for preventing farther than a maximum tilt of a venetian blind or preventing a roller blind from being rolled-up too far whereby its bottom would collide against its roller or its housing.

The chain stoppers are often larger than the cross-section of the balls or entrance into the clutch covers. These stoppers thus block the ball chains at the bottom of the sprocket covers and prevent the ball chains from being further pulled over their sprocket wheels.

Beaded (ball) chains or cords are thus utilized in roller shades, curtains and blinds for opening or closing the roller shades, curtains or blinds in a horizontal or vertical direction. Existing beaded chains utilize a continuous headed chain in which all of the beads are of uniform size except one or two stopper beads which are of larger size. Such beaded chains introduce a purely "by chance" event when rotating the chains as there is no way for an operator to know which chain direction is going to produce the desired result. In some situations, a person desiring to open the roller shade, curtains or blinds will pull on a side of a chain/cord only to jam or disengage from the clutch mechanism. For example, excessive forces applied to the ball chain can cause the larger chain stopper to crash into the clutch housing and disengage the ball chain or cause other damage to components of the clutch.

In addition to frustrating the operator, pulling the beaded chain in the undesired direction introduces unnecessary wear and tear on the mechanisms of the roller shades, curtain or blinds. For example, if a roller shade is fully opened, a hard tug on the chain stresses the chain because the roller shade does not move in response to the downward pulling force. A strong tug on the chain when the roller shade is at full extension, either opened or closed, has the potential of snapping the chain, damaging the housing or clutch, or worse, pulling an entire assembly off of a wall. Similarly, a tug on the incorrect side of the beaded chain, will cause the beaded chain or the gearing to slip which, over an extended time, will degrade the rotational mechanisms of the blinds.

A beaded chain of the prior art does not provide an operator with the opportunity to learn which chain side to pull because the beaded chain tends to hang in such a manner that the sides of the chain are indistinguishable. For example, the chain sides often are touching or are wound around each other, and may not be in predictable locations, e.g. to the front or to the back, due to interference with the blinds, furniture, or the window sill. Further, the typical operator does not have the patience to scrutinize the chain and sprocket (not shown) to determine which side to pull.

SUMMARY OF THE INVENTION

The present invention overcomes the disadvantages and shortcomings of the prior art by providing a control device which limits chain stopper collisions with the clutch housing or cover. The present invention provides a device which limits the transfer of forces to the clutch housing, such as resulting from excessive pulling of the chain. Instead, the device redirects forces applied through the chain, particularly through the chain stopper, to a location remote from the housing and clutch assembly.

A device of the present invention provides a user with an indication of desired chain movement wherein chain movement is limited in one direction upon stopper contact with the device. A chain control device enables a user to manipulate roller shades in a desired manner while limiting threes applied by the chain to the clutch mechanism.

It is another advantage to provide a chain control device that prevents wear and tear on the clutch or drive mechanisms by tactilely prompting a user to pull the correct side of the chain or cord to effect a desired movement of the shade. The chain control device of the exemplary embodiment utilizes a spring sized to provide a tactile differentiation as the spring is compressed.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which:

FIG. 10 is a perspective view of the spring clip of the connector of FIG. 9.

FIG. 11 is a perspective view of a forth embodiment of a shade control device of the present invention.

FIG. 12 is a top view of the control device of FIG. 11

FIG. 13 is a cross-sectional view of the control device of FIG. 12 taken along lines 13-13.

DETAILED DESCRIPTION OF THE INVENTION

Figure 1:
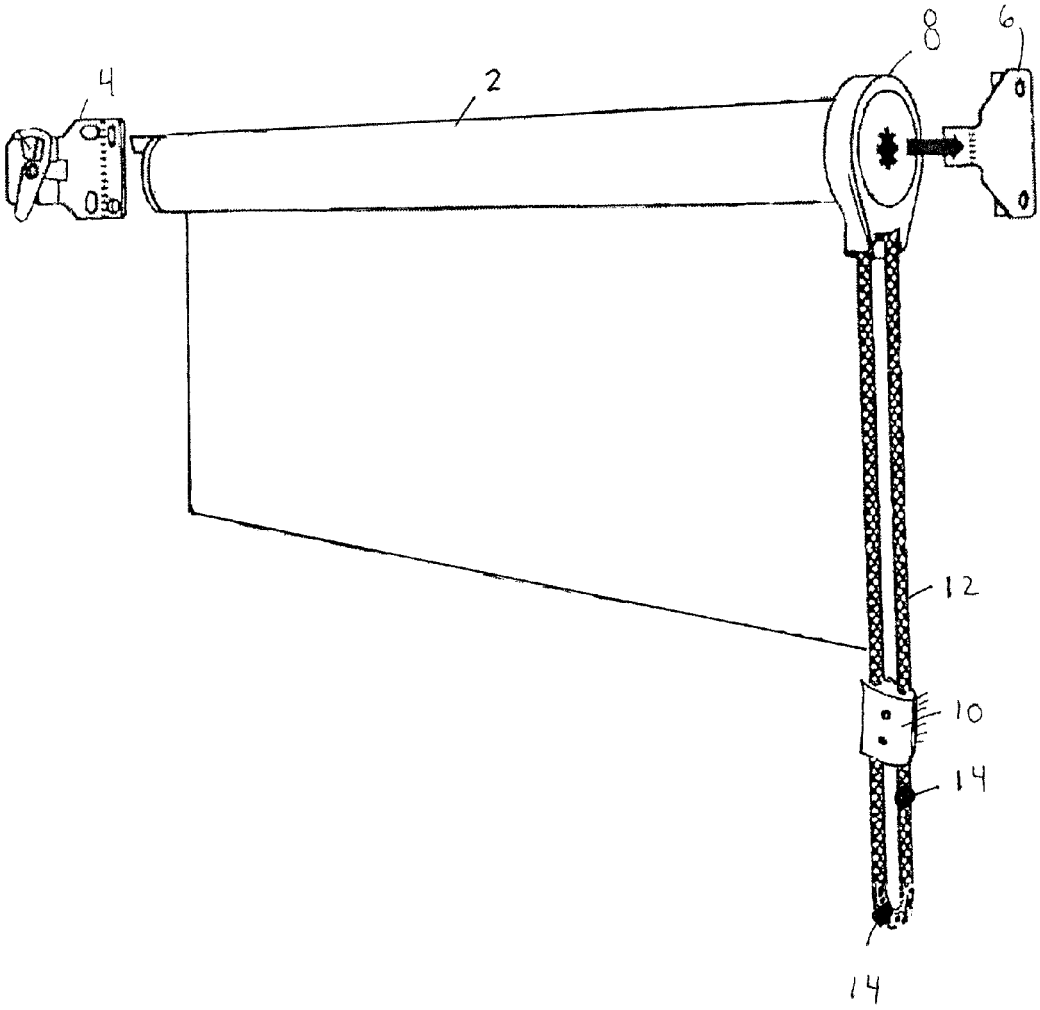
FIG. 1 is a perspective view of a roller shade and control device of the present invention.

Referring to FIG. 1, a roller shade 2 is supported by a pair of brackets including a end plug bracket 4 and a clutch bracket 6. A clutch 8 is provided at an end of shade 2 and is supported upon clutch bracket 6. Clutch 8 is engaged to rotate the roller shade into a desired position by a pulling manipulation of chain 12. A control device 10 of the present invention engages chain 12 at a location remote from the clutch 8. Preferably control device 10 is secured to a window frame or molding or nearby wall surface.

Control device 10 includes a body adapted to receive portion of chain, such as ball chain 12. Other chains, such rope or segmented metal chains may also be used. Ball chain 12 is utilized as described above to control movement of a roller shade 2. Ball chain 12 is provided with stoppers 14, which in this embodiment, are larger ball elements. Ball chain 12 may include multiple ball stoppers to control movement of the roller shade. For example, one ball stopper 14 may be used to delimit the upper or open position of the shade and another ball stopper 14 may be used to delimit the lower or closed position of the shade. Examples of chain drive systems for window shades include U.S. Pat. No. 4,424,852, Bead-Chain Drive System for Window Shade, and U.S. Pat. No. 5,137,073, Chain Pulling Device, each patent being incorporated by reference.

Figure 2:
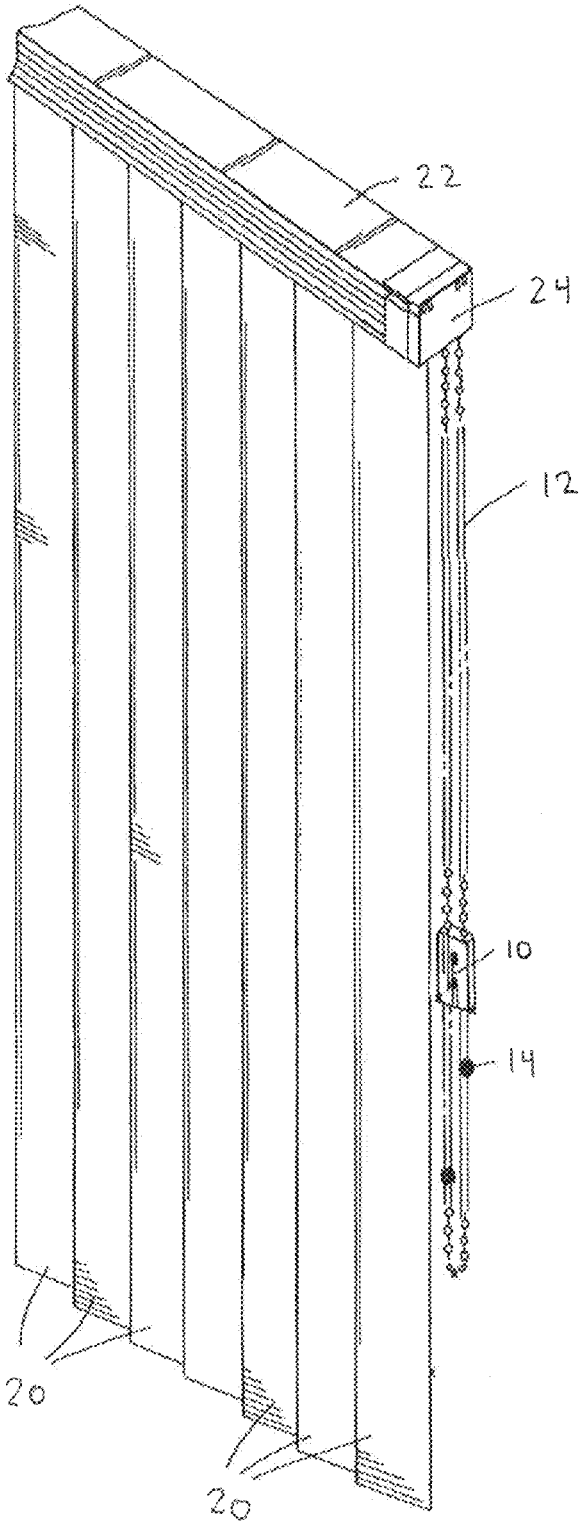
FIG. 2 is a perspective view of a vertical blind and control device of the present invention.

FIG. 2 illustrates another embodiment of a shade system include a plurality of vertical blinds 20 supported by a housing 22 and positioned by a bead chain-driven clutch 24. Control device 10 of the present invention is positioned away from housing 22, preferably secured to a window frame or nearby wall. Ball chain 12 and stoppers 14 are utilized to control the position of vertical blinds 20.

FIG. 3 through FIG. 7 illustrate a first embodiment of the invention. Control device 10 includes a body 30 and a pair of springs 32 held within body 30. Spring caps 34 are inserted into ends of springs 32. Spring caps 34 include an opening 36 through which ball chain 12 passes, but openings 36 prevent ball stoppers 14 from passing. Springs 32 and spring caps 34 are thus held within body 30, but are free to react to forces applied by ball chain 12 and ball stoppers 14.

Figure 3:
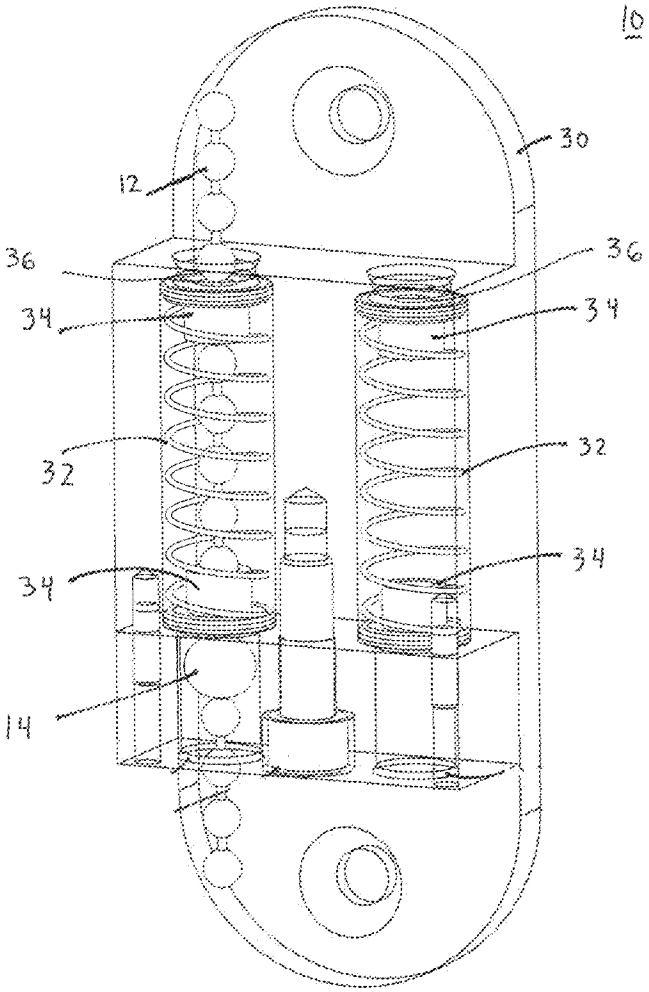
FIG. 3 is a perspective view of the shade control device of FIG. 1.

During operation of the control device 10, ball stopper 14 engages and compresses spring 32 held within the body 30. Ball stopper 14 may assume other designs or configurations functioning to provide some structural differentiation to the other elements of the ball chain 12. For simplicity of explanation, only a portion of the ball chain 12 is shown in FIG. 3 and a second portion of ball chain 12 (not shown) would pass through other spring 32.

Figure 4:
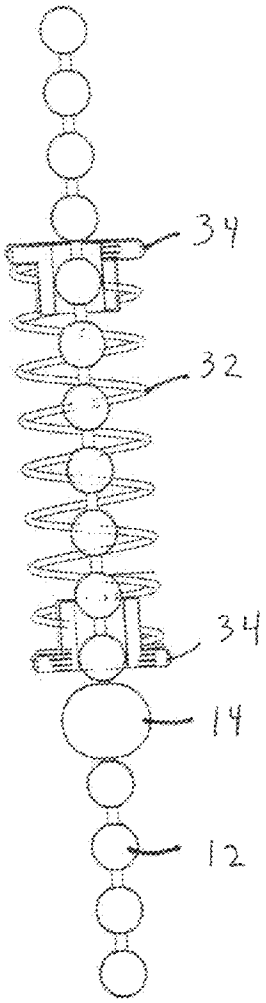
FIG. 4 is a view of the beaded chain and stopper engaging the spring and spring caps of the control device of FIG. 1.

FIG. 4 shows the spring 32, spring caps 34, chain 12 and stopper 14. Ball stopper 14 engages spring 32 via lower spring cap 34. Spring caps 34 have a first end sized to be received into the spring 32 and a second, wider end sized to engage stopper 14.

Figure 5:
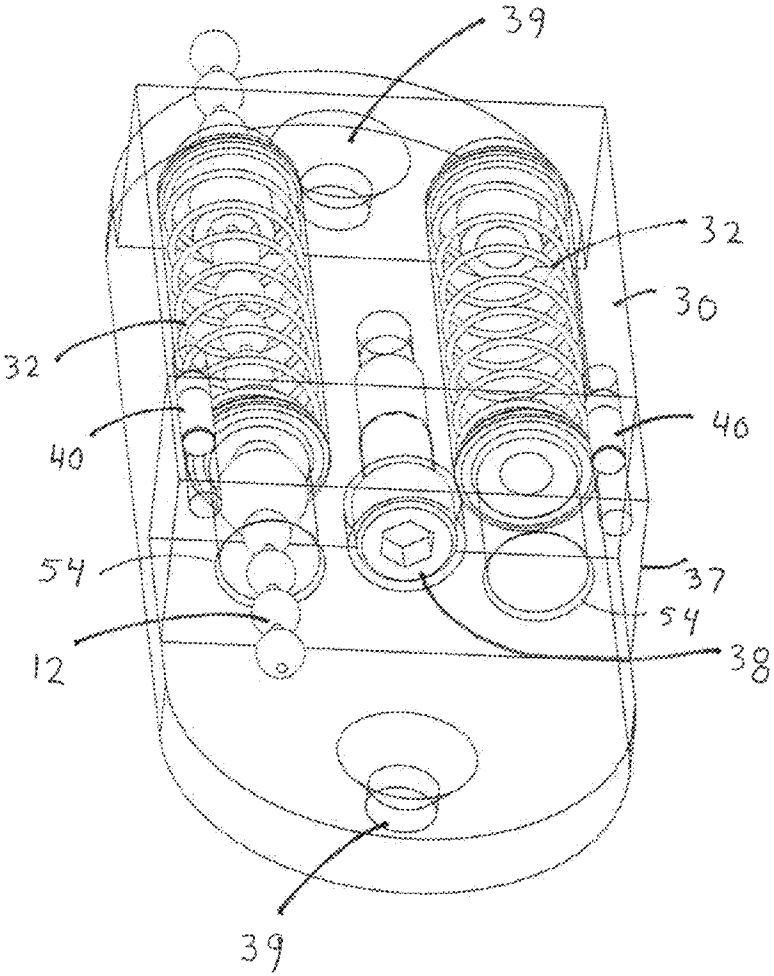
FIG. 5 is another perspective view of the shade control device of FIG. 1
Figure 6:
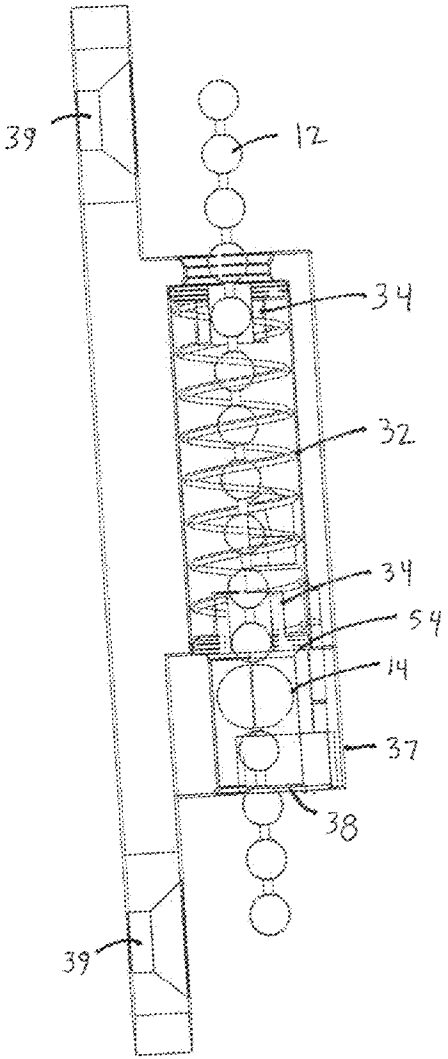
FIG. 6 is a cross-sectional view of the shade control device of FIG. 1.

Referring to FIGS. 5 and 6, the springs 32 and spring caps 34 are held within the body 30 by a retaining 37. Retaining 37 is secured to the body 13 via a threaded fastener 38. A pair of alignment pins 40 are utilized to align the retainer 37 upon body 30, such as during assembly. The ball stoppers 14 are sized to pass through openings in retainer 37 so as to engage with springs 32 and spring caps 34. The control device 10 is adapted to be secured to a wall or window structure with threaded fasteners passing through a pair of apertures 39 in body 30.

Figure 7:
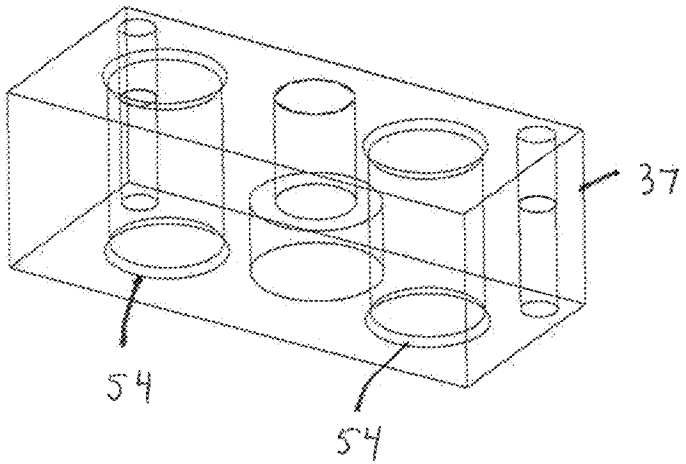
FIG. 7 is a perspective view of the retainer of the shade control device of FIG. 1.

Referring to FIG. 7, retaining 37 has a pair of apertures 54 through which the ball chain 12 and ball stoppers 14 can pass. The apertures 54 are sized to prevent the spring retainers caps 34 from escape out of body 30.

Body 30 is adapted to be secured to a wall or other surface via threaded fasteners (not shown) passing through apertures 39. Body 30 is secured against internal and external surfaces of the window frame or other opening. The body 30 is preferably secured at a location away from the roller shade housing.

In operation, the user applies tension to the chain 12 causing movement of the roller shade. The tension force being transferred to the clutch/drive assembly is effectively limited when the ball stopper 14 engages the control device 10 of the present invention. As the ball stopper 14 engages the spring cap 34, the spring 32 is compressed within body 30. If the user applied tension on the chain is sufficient, spring 32 is fully collapsed and the ball stopper 14 is stopped by contact with inner surfaces of the housing 30 or contact between spring retainers 34. The device thus redirects destructive forces applied to the ball chain 12 away from the clutch housing/drive assembly to a remote location (wall, window casing, etc.)

Springs 32 may be held within body 30 without the use of retainer 36. For example, the springs 32 could be inserted through an opening (not shown) at the back face of body the surface held against wall or window frame). The springs 32 could simply be compressed and inserted into an elongated cavity. The cavity could be cylindrical in form with ends tending to engage and secure the spring 32 within the body 30. A variety of spring retention structures could be used to maintain the spring 32 within the body 30.

The spring caps 34 could be eliminated by using a different spring, for example, a coil spring having reduced diameter ends. A variety of different springs could be utilized in alternative embodiments. For example, a resilient polymer spring may be utilized in place of coiled spring 32. Or, a foam or fluid-filled shock absorbing element could be utilized in place of spring 32.

The ball chains 12 could be shaped by balls formed on a chain or cord. The balls could be spherical or non-spherical. For example, a rectangular (cylindrical) stopper may be utilized.

Figure 8:
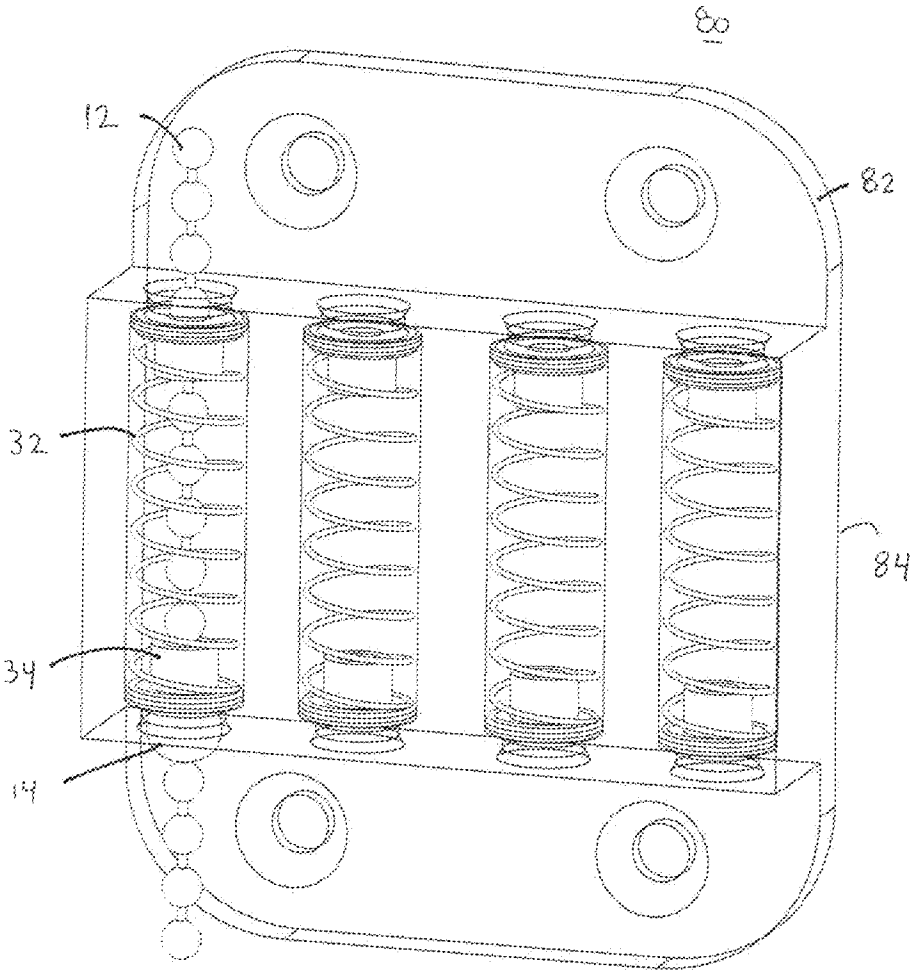
FIG. 8 is a perspective view of another embodiment of a shade control device of the present invention.

FIG. 8 illustrates another embodiment of the invention which a single control device 80 is utilized with a pair of shades (not shown). The control device 80 is positioned between the pair of shades and four segments of hall chains 12 are received into the control device 80. For simplicity of explanation, only a single ball chain 12 is shown in FIG. 8. The springs 32 and spring retainers 34 of control device 80 may be placed into the body 82 through openings accessible at the rear side 84 of body 82. The chain stoppers 14 engage the springs 32 through lower openings in body 82.

Figure 9:
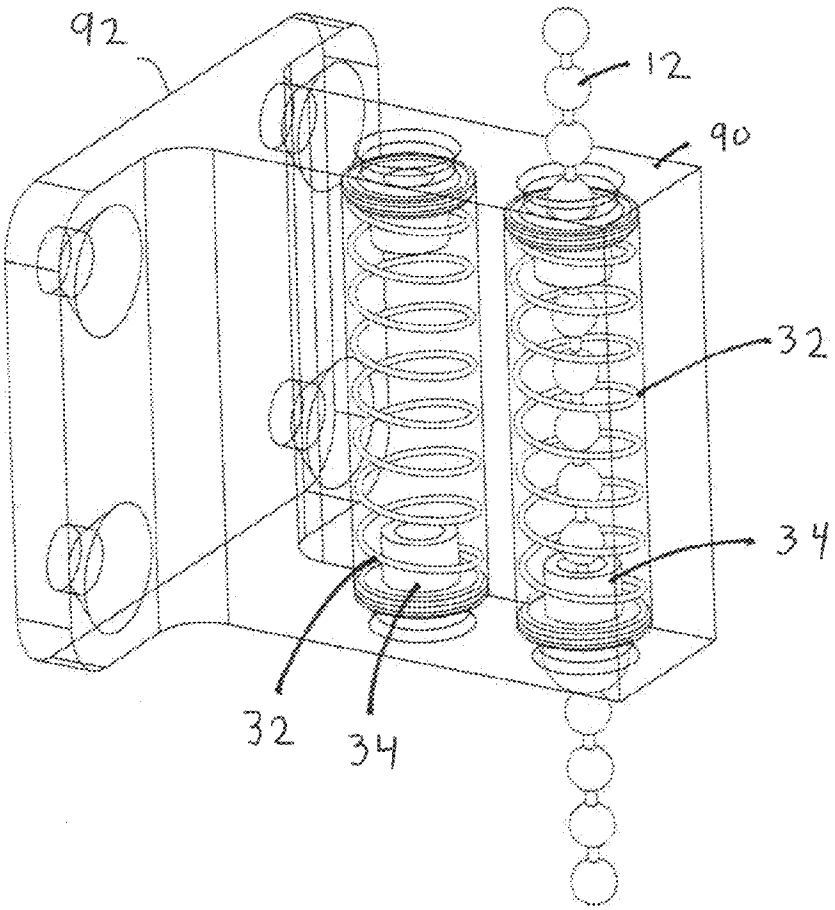
FIGS. 9 and 10 are perspective views of a third embodiment of a shade control device of the present invention.

FIG. 9 illustrates yet another embodiment of the invention 90 where the body includes a mounting plate 92 which is generally perpendicular to a plane containing the springs 32. The mounting plate 92 would allow the control device 90 to be mounted, for example, within a window frame interior or window moldings, depending on the application.

Figure 10:
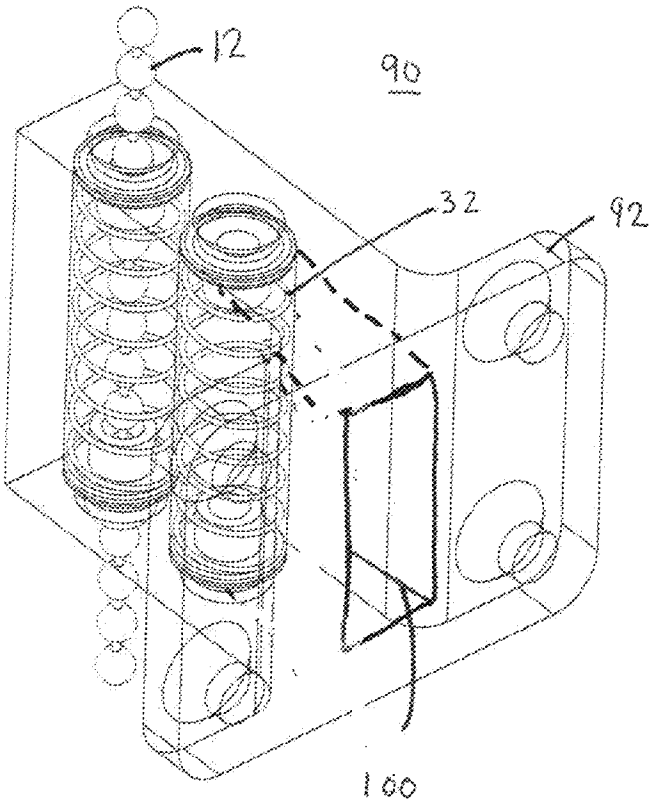

FIG. 10 is another view of the control device 90 of FIG. 9 showing a rear access 100 through which the spring 32 and spring retainers 34 are inserted, such as during manufacture.

FIG. 11 is a perspective view of another embodiment of the present invention. A control device 102 include a body 113, a pair of springs 132, spring caps 134, and cap retainers 135. Cap retainers 135 secure the springs and caps 134 within body 113. Cap retainer 135 includes a latch structure to prevent it from being dislodged. Body 113 is shown mounted to bracket 136. Body 113 can also be directly mounted to a window frame or wall surface without the use of bracket 136. Body 113 can be mounted to intermediate bracket 136 which is mounted to a window frame or wall surface. Bracket 136 can be used to mount the control device 102 within certain window interiors.

Figure 14:
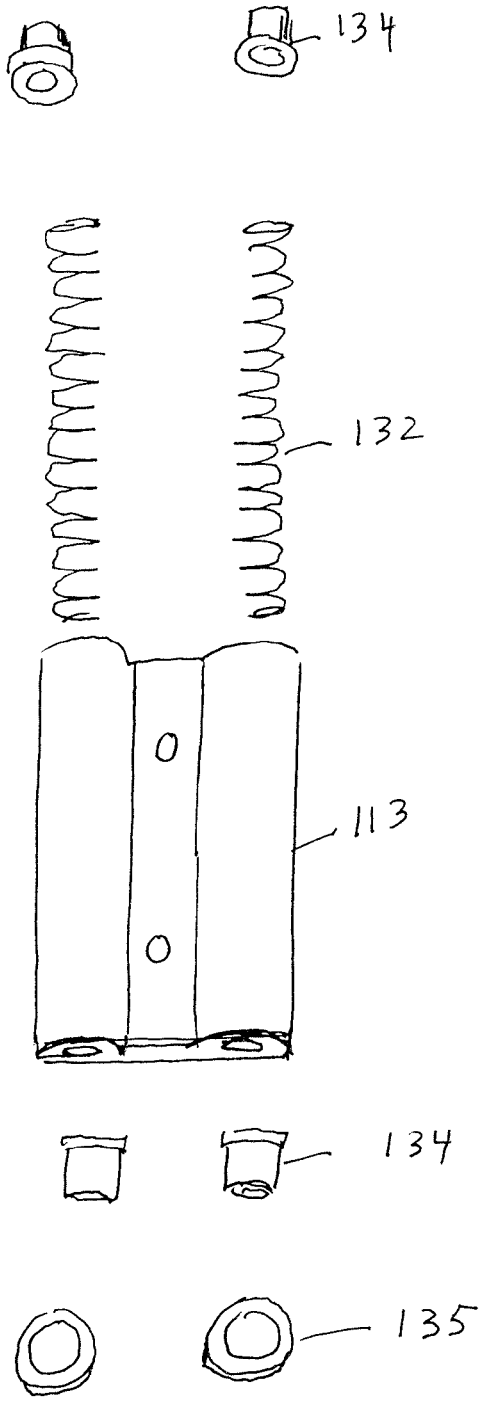
FIG. 14 is an exploded perspective view of the control device of FIG. 11

FIG. 12 is a top view of control device 102 showing body 113 secured to bracket 136 via fastener 138. FIG. 13 is a cross-sectional view of control device 102 taken along lines 13-13 in FIG. 12. FIG. 14 is an exploded view of the control device 102.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. A control device for shades, comprising:

a housing containing at least one spring, with said housing being secured to a surface at a location remote from a shade drive assembly, said shade drive assembly for moving a shade in a first direction when the drive assembly rotates in a first direction and in a second direction when the drive assembly rotates in a second direction, with said shade being positioned by a chain operable with the drive assembly for rotating the drive assembly in one of the first direction or second direction, and with said chain having a stopper attached to the chain, wherein the stopper engages and compresses said at least one spring when a tension force is applied to the chain, and said stopper is prevented from passing through the housing so as to redirect forces applied through the chain away from the shade drive assembly and to said remote location.

2. The device of claim 1, wherein the chain is a continuous loop.

3. The device of claim 1, wherein the chain is a beaded chain and said stopper is larger than other beads of the beaded chain.

4. The device of claim 3 wherein the beaded chain comprises at least a pair of separate beaded chains.

5. The device of claim 4 wherein said at least one spring includes at least one spring for each section of the beaded chain loops.

6. The device of claim 1 wherein said at least one spring is secured within the housing by a retainer.

7. The device of claim 6 further comprising a plurality of spring caps positioned at ends of the at least one spring and adapted to engage the stopper.

8. The device of claim 7 wherein the spring caps include a first end adapted to be received into the spring interior and a second end adapted to contact the stopper.

9. The device of claim 1 wherein the chain passes through the chain control device until the stopper engages the spring and is stop from further movement through the control device.

10. A method of using a roller shade assembly having a drive assembly rotated in a first direction or a second direction by a beaded chain and with ball stoppers attached to the chain, the method comprising the step of:

securing a control device including a body and spring at a location remote from the drive assembly, with said spring being captured within the body of the control device;

passing the beaded chain through apertures of the body, whereby the ball stoppers engage and compresses the spring after the beaded chain is moved in said first or second direction; and as said spring is compressed, redirecting tension forces applied by the user to the beaded chain to a location away from the sprocket assembly and into the control device.

11. A control device for shades comprising:

a housing containing a spring, with said housing being secured to a surface at a location remote from a shade drive assembly, and with a stopper adapted to engage and compress the spring when force is applied to a chain, with the drive assembly for moving a shade between first and second orientations, and with the chain operable with the drive assembly for rotating the drive assembly until the stopper is blocked from further movement by the control device, wherein the chain is a beaded chain and said stopper is larger than other beads of the beaded chain.

12. The device of claim 11, wherein the chain is a continuous loop.

13. The device of claim 11 further comprising a plurality of spring caps positioned at ends of the spring and adapted to engage the stopper.

14. The device of claim 13 wherein the spring caps include a first end adapted to be received into the spring interior and a second end adapted to contact the stopper.

15. The device of claim 11 wherein the chain passes through the chain control device until the stopper engages and fully compresses the spring and is stopped from further movement through the control device.

16. The device of claim 11 further comprising a bracket for securing the control device to a window frame surface.

17. The device of claim 11 wherein the control device includes a pair of springs held within the body and with one of the springs being compressed when the shade is in a full open position and the other spring being compressed with the shade is moved into a full closed position.

18. The device of claim 11 wherein the control device includes a plurality of springs to control a pair of adjacent window shades.

* * * * *